US005143154A

United States Patent [19]

Mody et al.

[11] Patent Number: 5,143,154

[45] Date of Patent: Sep. 1, 1992

[54] INFLATABLE PACKING ELEMENT

[75] Inventors: Rustom K. Mody, Houston; Floyd A. Halbardier, deceased, late of Pasadena, Tex., by Anna L. Halbardier, heiress

[73] Assignee: Baker Hughes Incorporated, Houston, Tex.

[21] Appl. No.: 766,965

[22] Filed: Sep. 25, 1991

Related U.S. Application Data

[63] Continuation of Ser. No. 492,841, Mar. 13, 1990, abandoned.

[51] Int. Cl.[5] ..... E21B 33/127

[52] U.S. Cl. ..... 166/187; 166/192; 277/34

[58] Field of Search ..... 166/179, 187, 192, 195; 277/34, 34.3

[56] References Cited

U.S. PATENT DOCUMENTS

| | | | |
|---|---|---|---|
| 1,549,168 | 8/1925 | Townsend . | |
| 2,643,722 | 6/1953 | Lynes et al. . | |
| 2,727,576 | 12/1955 | Hall . | |
| 2,738,019 | 3/1956 | Atkinson . | |
| 2,778,432 | 1/1957 | Allen . | |
| 3,085,627 | 8/1958 | Sodich . | |
| 3,085,628 | 4/1963 | Malone . | |
| 3,160,211 | 12/1964 | Malone . | |
| 3,338,310 | 8/1967 | McGill . | |
| 3,437,142 | 4/1969 | Conover . | |
| 3,502,037 | 3/1970 | Pickard . | |
| 3,524,503 | 8/1970 | Baker . | |
| 3,527,296 | 9/1970 | Malone . | |
| 3,529,667 | 9/1970 | Malone . | |
| 3,542,127 | 11/1970 | Malone | 166/187 |
| 3,556,042 | 1/1971 | Laughlin | 166/241 |
| 3,581,816 | 6/1971 | Malone | 166/187 |
| 3,604,732 | 9/1971 | Malone . | |
| 3,606,924 | 9/1971 | Malone | 166/187 |
| 3,627,046 | 12/1971 | Coone et al. | 166/278 |
| 3,749,521 | 7/1973 | Coone | 417/53 |
| 3,837,947 | 9/1974 | Malone | 277/34 |
| 3,854,694 | 12/1974 | Coone | 277/34 |
| 4,003,581 | 1/1977 | Hutchinson | 277/34.6 |
| 4,011,907 | 3/1977 | Clay | 166/241 |
| 4,052,861 | 10/1977 | Coone et al. | 61/86 |
| 4,063,421 | 12/1977 | Coone et al. | 61/102 |
| 4,077,224 | 3/1978 | Coone | 61/94 |
| 4,191,383 | 3/1980 | Baker et al. | 277/1 |
| 4,253,676 | 3/1981 | Baker et al. | 166/187 |
| 4,310,161 | 1/1982 | Streich | 277/34 |
| 4,311,314 | 1/1982 | Suman | 166/187 |
| 4,349,204 | 9/1982 | Malone | 166/187 |
| 4,403,660 | 9/1983 | Coone | 166/387 |
| 4,406,461 | 9/1983 | McGill | 166/187 |
| 4,413,653 | 11/1983 | Carter, Jr. | 277/34 |
| 4,424,861 | 1/1984 | Carter, Jr. et al. | 166/187 |
| 4,520,869 | 6/1985 | Svenson | 166/241 |
| 4,544,165 | 10/1985 | Coone | 277/34 |
| 4,545,436 | 10/1985 | Harrison | 166/241 |
| 4,651,823 | 3/1987 | Spikes | 166/241 |
| 4,768,590 | 9/1988 | Sanford et al. | 277/34 |
| 4,832,120 | 5/1989 | Coronado | 277/34 |
| 4,871,179 | 10/1989 | Bell et al. | 166/187 |
| 4,875,524 | 10/1989 | Bradley et al. | 166/241 |
| 4,892,144 | 1/1990 | Coone | 166/187 |
| 4,909,322 | 3/1990 | Patterson et al. | 166/241 |
| 4,923,007 | 5/1990 | Sanford et al. | 166/187 |
| 5,024,273 | 6/1991 | Coone et al. | 166/187 X |

*Primary Examiner*—Terry Lee Melius
*Attorney, Agent, or Firm*—Melvin A. Hunn

[57] ABSTRACT

An inflatable packing element for an inflatable packer or bridge plug utilized in subterranean wells comprises a tubular elastomeric sleeve which is surrounded by a plurality of circumferentially overlapping flexible metal ribs. The opposite ends of the ribs are respectively welded to an external surface provided on a force transmitting sleeve. The sleeve is provided with a shoulder having an abutting relationship with an internally projecting shoulder provided on the tubular mounting structure for the inflatable element.

7 Claims, 2 Drawing Sheets

INFLATABLE PACKING ELEMENT

This application is a continuation of application Ser. No. 492,841, filed Mar. 13, 1990, now abandoned.

BACKGROUND OF THE INVENTION

1. FIELD OF THE INVENTION

The invention relates to the construction of an inflatable packing element for use in inflatable packers or bridge plugs employed in subterranean wells.

2. SUMMARY OF THE PRIOR ART

Inflatable packers (or bridge plugs) have long been utilized in subterranean wells. Such inflatable tools normally comprise an elastomeric sleeve element mounted in surrounding relationship to a tubular body portion. Pressured fluid is communicated from the surface of the well to the bore of the tubular body and then through radial passages to the interior of the elastomeric sleeve. To protect the elastomeric sleeve, it is customary to completely surround the elastomeric sleeve with a plurality of peripherally overlapping, resilient, reinforcing slats or ribs. The medial portions of the reinforcing ribs are surrounded and may be bonded to an outer annular elastomeric packing element or cover of substantial wall thickness. Upper and lower securing assemblies respectively engage the ends of the elastomeric sleeve and the reinforcing ribs and is fixedly and sealably secured relative to a central tubular body. A lower securing assembly is secured to a sealing sub which is mounted for slidable and sealable movement on the exterior of the central tubular body, in response to the inflation forces. A structure of this general type is shown in U.S. Pat. No. 3,160,211 to MALONE.

With inflatable packers of this type, very substantial tensile forces are exerted on the reinforcing slats or ribs during the inflation of the elastomeric sleeve. It has been customary to clamp the ends of the ribs to the upper and lower securing assemblies, but such clamping arrangements are subject to failure if the inflatable packer is repeatedly inflated for engagement with different portions of the well casing or conduit in which it is inserted.

More recently, the ends of the flexible ribs have been welded to an internal surface of a securing sleeve, in the manner indicated in FIG. 1 of the drawings. If the welding operation is properly accomplished, this provides a secure anchoring of the ends of the flexible ribs to the mounting sleeve, but those skilled in the art will recognize the difficulty of making consistently good welds within the relatively small bore of a mounting sleeve for the inflatable packing element of an inflatable packer. If one or more of the ribs is not properly welded, such ribs will break loose under the tensile forces imposed by the inflation of the elastomeric sleeve packer or element which is inserted within the ribs and, because there is thus created a weak area in the cylindrical cage of the reinforcing ribs, the substantial fluid pressure applied to the inflatable elastomeric sleeve can well push such rib out of alignment with the other ribs and thus produce a potential area of breakage of the inflatable elastomeric sleeve because it will follow the outward displacement of the unanchored rib and form a thin walled bubble.

There is a need therefore for an anchoring system for the peripherally stacked cage of flexible reinforcing ribs which normally surround the inflatable elastomeric sleeve of an inflatable packer or bridge plug which effects a reliable rigid connection of the ends of the ribs to the mounting sleeves for the expansible packing element.

SUMMARY OF THE INVENTION

In accordance with this invention, the ends of the cylindrical cage of peripherally overlapped slats or ribs surrounding an inflatable elastomeric sleeve of an inflatable packing element are respectively welded to an external surface of a force transmitting sleeve. Such force transmitting sleeve is further provided with an external shoulder which is disposed in abutting relationship with an internal shoulder provided on the respective mounting sleeve for securing the entire inflatable assemblage to the body of the inflatable packer or bridge plug. Additionally, the location of the abutting shoulders is deliberately selected so as to provide an axial length of the circumferential array of resilient slats or ribs in frictional contact with the internal bore of the mounting sleeve. Such frictional forces, which are greatly increased through the application of the inflation pressures to the apparatus, significantly reduce the tensile forces applied to the welds, hence minimizing the opportunity for any individual rib to break at its weld.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1:
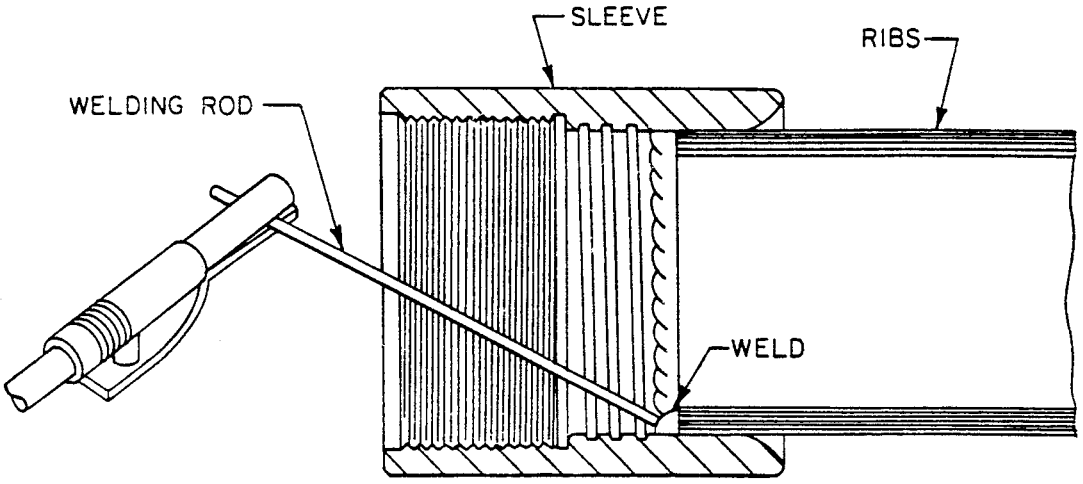
FIG. 1 PRIOR ART
FIG. 1 is a combination perspective and sectional view illustrating a prior art method of welding the ends of the reinforcing ribs to the mounting sleeve of an inflatable packer.

Referring to FIG. 1, a prior art construction for securing the reinforcing ribs of an inflatable element for an inflatable packer or bridge plug is shown. The ends of each rib is welded to an interior surface of a mounting sleeve. After the welding operation, a sleeve of elastomeric material (not shown) is inserted within the rib cage and the end secured in conventional fashion. It should be noted, however, that the welding has to be accomplished in a small internal bore surface and this is recognized to be a difficult procedure to consistently produce good welds for each of the multitude of reinforcing ribs.

Figure 2:
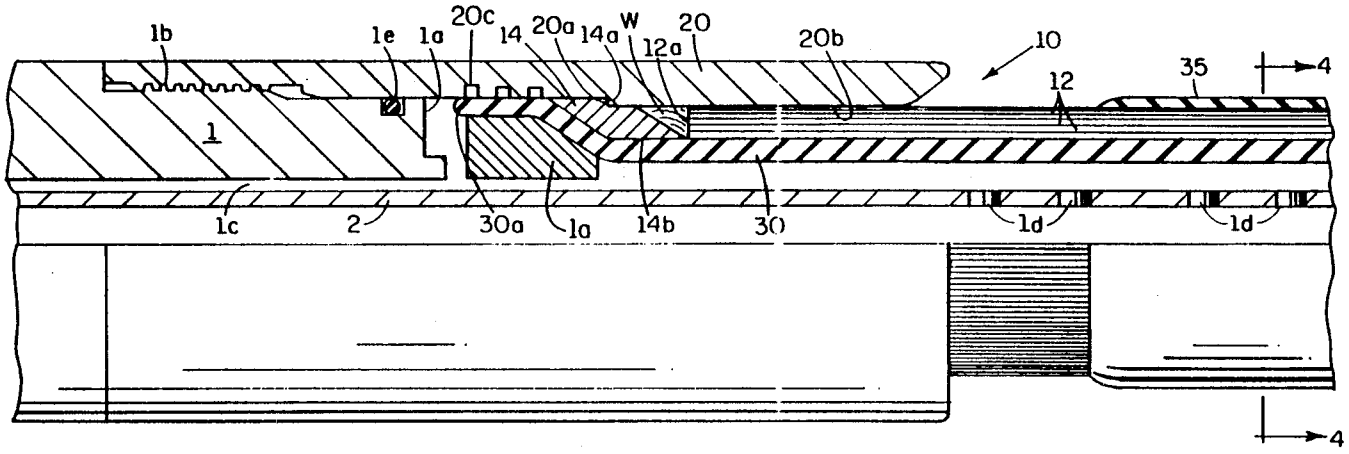
FIG. 2 is a vertical quarter sectional view of the mounting sleeve portion of an inflatable packer wherein the reinforcing ribs are secured by utilization of the construction of this invention.

Referring now to FIG. 2, only the upper securing portion of the inflatable element of an inflatable packer or bridge plug is shown. All other elements of the inflatable packer or bridge plug, including the valving apparatus for supplying inflation pressures are well known in the art. See for example, U.S. patent application Ser. No. 138,197, filed on Dec. 28, 1987; U.S. Pat. No. 4,708,208; and U.S. Pat. No. 4,805,699, and the disclosures of such patents are hereby incorporated by reference.

Figure 4:
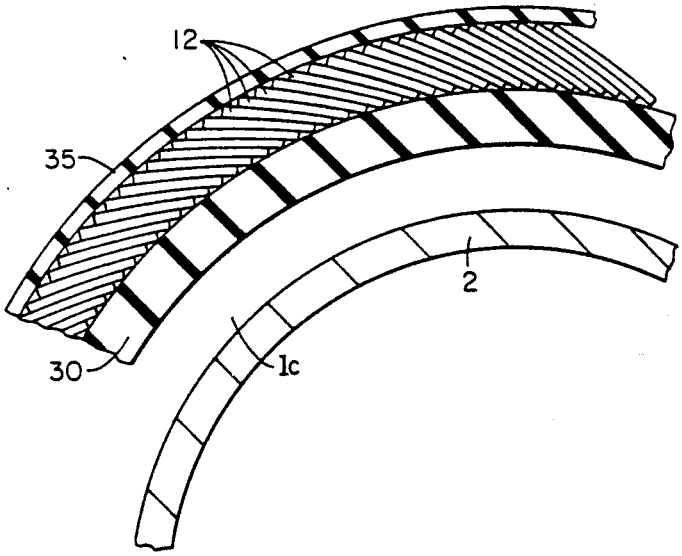
FIG. 4 is an enlarged scale sectional view taken on the plane 4—4 of FIG. 2.

Inflatable element 10 comprises a cylindrical cage of peripherally overlapping flexible slats or ribs 12, the configuration of which is best shown in the enlarged sectional view of FIG. 4. The ends 12*a* of such ribs are welded to a force transmitting sleeve 14 by a weld W which is accomplished after the insertion of the ribs through a mounting sleeve 20. The force transmitting sleeve 14 is provided with an external shoulder 14*a* which cooperates with an internal shoulder 20*a* provided on mounting sleeve 20 for transmitting tensile forces exerted on the ribs 12 to the mounting sleeve 20.

An inflatable tube or sleeve 30 of elastomeric material is inserted within the bore of the rib cage 12 and passes through the bore 14*b* of the force transmitting sleeve 14. Tube retainer 1*a* is installed inside the mounting sleeve 20 radially forcing the inflatable tube or sleeve 30 of elastomeric material to extrude and engage in appropriate circumferential grooves 20*c* formed in a mounting sleeve 20. Anchor portion 1 is further provided with external threads 1*b* for threadably engaging the upper end of the mounting sleeve 20. Such threads are sealed by an O-ring 1*e*.

A cover portion 35 of elastomeric material is bonded to the medial portions of the rib cage 12 to provide a sealing contact with the bore of a well or well conduit, as is customary.

As is customary in inflatable packers, the internal surface of anchor body 1 cooperates with an internal body tube 2 to define an annular passage 1*c* and radial ports 1*d* for application of fluid pressure to the interior of the elastomeric sleeve 30. The application and maintenance of fluid pressure on the interior of the elastomeric sleeve 30 is accomplished in a manner well known in the art and fully disclosed in the aforementioned patents, hence further description is deemed unnecessary. Thus, when such fluid pressure is applied through the fluid passage 1*c*, the inflatable packing element 10 is expanded to assume the configuration illustrated in FIG. 3. The tensile forces developed in the ribs 12 by such expansion are transmitted by the welds W to the force transmitting sleeve 14 and by the peripheral shoulder 14*a* to the mounting sleeve 20 and the anchor body 1.

Figure 3:
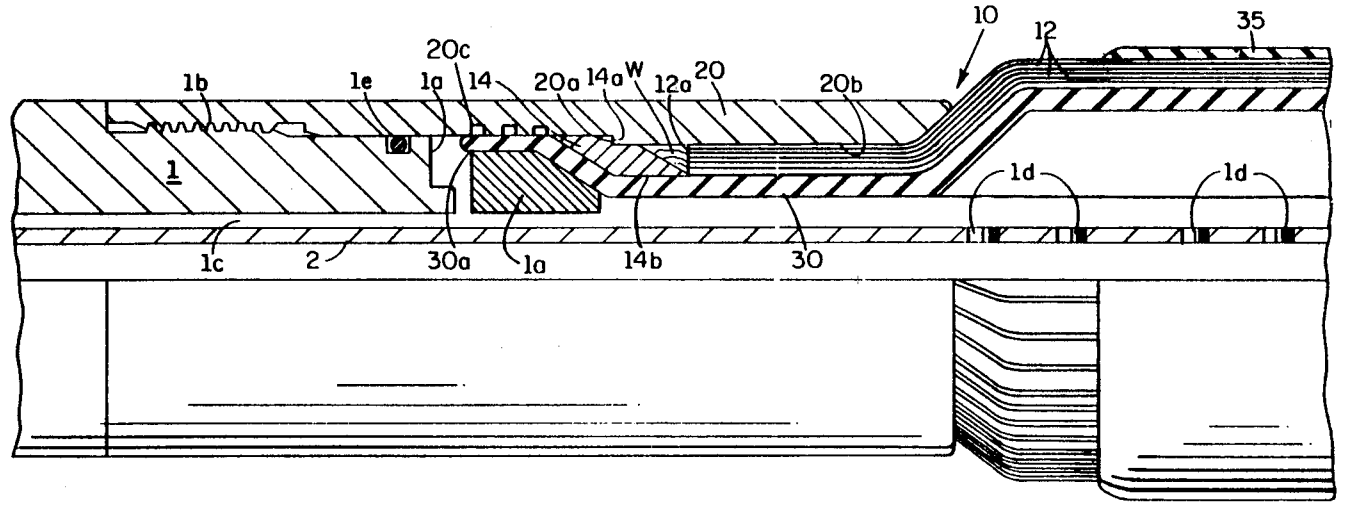
FIG. 3 is a view similar to FIG. 2 but illustrating the effects of application of inflation pressures to the elastomeric sleeve of the mounting construction of FIG. 1.

As best shown in FIG. 3, the location of the force transmitting sleeve 14 relative to the length of the mounting sleeve 20 is an important feature of this invention. The force transmitting sleeve is preferably located above the central or medial portion of the mounting sleeve 20 so that a substantial length of the ribs 12 are disposed in frictional engagement with the bore 20*b* of the mounting sleeve 20. These frictional forces are substantially increased by the fluid pressure forces illustrated by the arrows shown in FIG. 3 and result from the application of the inflation pressure.

It will be therefore be readily apparent to those skilled in the art that a very substantial frictional force may be developed to resist the tensile forces exerted on the reinforcing ribs 12 by the inflation of the elastomeric sleeve 30. Such frictional forces substantially diminish the tensile forces exerted on the welds W and thus provide further insurance against the separation of any of the welds W.

While only the mounting structure for one end of the inflatable packing element 10 has been shown, those skilled in the art will recognize that the other end of the element is of identical construction. Thus, the other ends of the reinforcing ribs 12 are secured by external welds W to a source transmitting sleeve which is identical to sleeve 14 except that it will be disposed in a vertically reversed relationship.

The aforedescribed construction resolves a troublesome constructural defect of inflatable packers or bridge plugs through not only the substantial elimination of welding defects caused by performing rib welds in an internal bore, but also significantly reduces the tensile forces applied to the welds through the utilization of an extended longitudinal bore area of the mounting sleeve in frictional contact with the reinforcing ribs 12 when such ribs are expanded by inflation pressure.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An inflatable packing element for use in a subterranean well comprising:

a tubular elastomeric body;

a plurality of elongated, peripherally adjacent, flexible metal ribs snugly surrounding at least the medial portion of said tubular elastomeric body;

an annular elastomeric packing cover disposed over at least a portion of said plurality of elongated peripherally adjacent flexible metal ribs;

a force transmitting sleeve eternally welded to at least one end of each said metal ribs and defining an external load transmitting shoulder; and a mounting sleeve for said force transmitting sleeve defining an internal shoulder abuttable with said force transmitting external shoulder of said force transmitting sleeve, thereby transmitting to said mounting sleeve the tensile forces produced in said ribs by fluid pressure expansion of said tubular elastomeric body.

2. The apparatus of claim 1 wherein said internal shoulder is disposed in a medial location in the mounting sleeve, whereby a length of the ends of said ribs is moved by expansion of said tubular elastomeric body into frictional engagement with the bore of said mounting sleeve, thereby absorbing a portion of said tensile forces.

3. An inflatable packing element for use in a subterranean well comprising:

a tubular elastomeric body;

a plurality of elongated, peripherally adjacent, flexible metal ribs snugly surrounding at least the medial portion of said tubular elastomeric body;

an annular elastomeric packing cover disposed over at least a portion of said plurality of elongated peripherally adjacent flexible metal ribs;

a load transmitting means eternally welded to each end of said metal ribs and defining an external load transmitting shoulder; and an anchor sleeve for each of said load transmitting means defining an internal shoulder abuttable with the respective load transmitting external shoulder of said load transmitting means, thereby transmitting to said anchor sleeves the tensile forces produced in said ribs by fluid pressure expansion of said tubular elastomeric body.

4. The apparatus of claim 3 wherein said internal annular shoulders are respectively disposed in a medial location in the anchor sleeves, whereby a substantially length of the ends of said ribs are respectively expanded by said tubular elastomeric body into frictional engagement with the bores of said anchor sleeves, thereby absorbing a portion of said tensile forces.

5. An inflatable packing element for use in a subterranean well comprising in combination:

a pair of tubular bodies having internally projecting annular shoulders;

a pair of end rings formed of a weldable material and respectively insertable in said tubular bodies;

a plurality of elongated flexible ribs also formed of a weldable material;

said ribs being disposed in a cylindrical, overlapping array, with each rib having its opposite ends respectively welded to the exterior of said end rings;

a sleeve of elastomeric material inserted in said cylindrical array of ribs;

a sleeve of elastomeric material disposed over at least a portion of said cylindrical array of ribs;

an external load carrying shoulder on each said ring; and said load carrying external shoulders being respectively abuttable with said internal shoulders of said tubular bodies to transit tension loads imposed on said ribs by inflation of said elastomeric sleeve.

6. The apparatus of claim 5 wherein said internal annular shoulders are respectively located in medial portions of said tubular bodes and the end portions of said ribs are respectively frictionally engaged with a substantial portion of the interior surfaces of said tubular bodies.

7. An inflatable packing element for use in subterranean well, comprising:

a tubular elastomeric body;

elongated, peripherally adjacent, reinforcing means snugly surrounding at least the medial portion of said tubular elastomeric body;

an annular seal member disposed over at least a central region of said elongated, peripherally adjacent reinforcing means;

a force transmitting sleeve eternally secured to at least one end of said reinforcing means and defining an external load transmitting shoulder; and mounting means for said load force transmitting sleeve defining an internal shoulder abuttable with said force transmitting external shoulder of said force transmitting sleeve, for receiving from said force transmitting sleeve the tensile forces produced by said reinforcing means by said fluid pressure expansion of said tubular elastomeric body.

* * * * *

UNITED STATES PATENT AND TRADEMARK OFFICE

CERTIFICATE OF CORRECTION

PATENT NO. : 5,143,154
DATED : September 1, 1994
INVENTOR(S) : Mody, et al.

It is certified that error appears in the above-indentified patent and that said Letters Patent is hereby corrected as shown below:

At column 3, line 55, delete "be" between "therefore" and "readily".

At column 3, line 68, delete "source" and insert -- force -- therefore.

At column 4, line 32, insert -- , -- between "adjacent" and "flexible".

At column 4, line 33, delete "eternally" and insert -- externally -- therefore.

At column 4, line 59, delete "eternally" and insert -- externally -- therefore.

At column 6, line 5, delete "bodes" and insert -- bodies -- therefore.

At column 6, line 12, insert -- a plurality of -- before "elongated".

At column 6, line 18, delete "eternally" and insert -- externally -- therefore.

At column 6, line 21, insert -- a -- before "mounting"

Signed and Sealed this

Fourth Day of March, 1997

Bruce Lehman

*Attest:*

BRUCE LEHMAN

*Attesting Officer*

*Commissioner of Patents and Trademarks*